US005570521A

United States Patent [19]

Baker et al.

[11] Patent Number: 5,570,521

[45] Date of Patent: Nov. 5, 1996

[54] CONTROL SYSTEM FOR A GRAIN DRYER AND PROBE MOUNTING APPARATUS THEREFOR

[75] Inventors: William Baker, Indianapolis; Raymond G. Benson, Plainfield; Brent J. Bloemendaal, Indianapolis; Phong B. Chau, Indianapolis; John J. Robinson, Indianapolis, all of Ind.

[73] Assignee: ffi Corporation, Indianapolis, Ind.

[21] Appl. No.: 430,539

[22] Filed: Apr. 25, 1995

Related U.S. Application Data

[63] Continuation of Ser. No. 66,046, filed as PCT/US91/09046 Nov. 26, 1991, abandoned, which is a continuation-in-part of Ser. No. 617,586, Nov. 26, 1990, abandoned.

[51] Int. Cl.[6] ..... F26B 19/00

[52] U.S. Cl. ..... 34/550; 34/560

[58] Field of Search ..... 34/550, 423, 428, 34/429, 446–47, 474–75, 483–84, 560, 575

[56] References Cited

U.S. PATENT DOCUMENTS

| | | | |
|---|---|---|---|
| 2,858,620 | 11/1958 | Naylor | 34/56 |
| 3,380,174 | 4/1968 | McClaren | 34/26 |
| 3,400,466 | 9/1968 | McClaren | 34/25 |
| 3,636,638 | 1/1972 | Noyes | 34/45 |
| 3,736,667 | 6/1973 | McClaren | 34/48 |
| 3,787,985 | 1/1974 | Fowler et al. | 34/45 |
| 3,795,984 | 3/1974 | Meyer | 34/46 |
| 3,946,496 | 3/1976 | Sukup | 34/56 |
| 3,948,277 | 4/1976 | Wochnowski et al. | 131/135 |
| 4,004,351 | 1/1977 | Sanneman et al. | 34/52 |
| 4,149,844 | 4/1979 | Noyes | 432/17 |
| 4,152,840 | 5/1979 | Stille | 34/56 |
| 4,253,243 | 3/1981 | Whelan | 34/31 |
| 4,253,244 | 3/1981 | Kranzler | 34/48 |
| 4,255,869 | 3/1981 | Quester et al. | 34/25 |
| 4,257,169 | 3/1981 | Pierce | 34/27 |
| 4,270,280 | 6/1981 | McClaren | 34/30 |
| 4,302,888 | 12/1981 | Boldt | 34/48 |
| 4,372,053 | 2/1983 | Anderson et al. | 34/11 |
| 4,386,471 | 6/1983 | Bowrey et al. | 34/26 |
| 4,423,557 | 1/1984 | Westelaken | 34/56 |
| 4,434,563 | 3/1984 | Graalmann et al. | 34/28 |
| 4,471,424 | 9/1984 | Persson | 364/145 |
| 4,490,924 | 1/1985 | Lambert | 34/31 |
| 4,513,759 | 4/1985 | Wochnowski et al. | 131/305 |
| 4,555,858 | 12/1985 | Hegedus et al. | 34/168 |
| 4,558,523 | 12/1985 | Isbell et al. | 34/30 |
| 4,578,878 | 4/1986 | Mizuta et al. | 34/46 |
| 4,599,809 | 7/1986 | Parkes | 34/31 |
| 4,642,906 | 2/1987 | Kantze et al. | 34/13 |

(List continued on next page.)

OTHER PUBLICATIONS

Dryer Master Inc., "Benefits of Moisture Control with Dryer Master".

*Primary Examiner*—John M. Sollecito
*Assistant Examiner*—Steve Gravini
*Attorney, Agent, or Firm*—Barnes & Thornburg

[57] ABSTRACT

A control system (80-1, 80-2) is provided for a grain dryer (10) having a path (22, 24) along which grain is conveyed from an entry opening (28) between first (12, 14) and second (18, 20) walls provided with second openings through which drying air can flow. A source (16) on the side of the first wall opposite the grain provides a flow of air through the first wall, through the grain and through the second wall to dry the grain. The grain dryer (10) further comprises metering rolls (30, 32) between the walls (12, 18, 14, 20) adjacent the end opposite the entry opening (28) to control the movement of the grain along the path (22, 24). The control system includes a first moisture probe (80-1) positioned remote from the metering rolls (30, 32), a second moisture probe (80-2) positioned adjacent the metering rolls (30, 32), and a microcomputer (150). The first (80-1) and second (80-2) moisture probes and the metering rolls (30, 32) are coupled to the microcomputer (150) for control of the metering rolls (30, 32) based upon the outputs of the moisture probes (80-1, 80-2).

8 Claims, 9 Drawing Sheets

U.S. PATENT DOCUMENTS

| | | | |
|---|---|---|---|
| 4,660,298 | 4/1987 | Nambu et al. | 34/30 |
| 4,696,115 | 9/1987 | Spadafora | 34/46 |
| 4,712,311 | 12/1987 | Peifer | 34/56 |
| 4,750,273 | 6/1988 | Parkes et al. | 34/484 |
| 4,896,795 | 1/1990 | Ediger et al. | 222/63 |
| 4,916,830 | 4/1990 | Braun et al. | 34/48 |
| 5,189,812 | 3/1993 | Ediger | 34/483 |

CONTROL SYSTEM FOR A GRAIN DRYER AND PROBE MOUNTING APPARATUS THEREFOR

This application is a continuation of U.S. Ser. No. 08/066,046, filed Jul. 23, 1993, which is the U.S. national phase of PCT/US91/09046, filed Nov. 26, 1991. PCT/US91/09046 is continuation-in-part of U.S. Ser. No. 07/617,586, filed Nov. 26, 1990. U.S. Ser. No. 08/066,046, PCT/US91/09046 and U.S. Ser. No. 07/617,586 are all now abandoned.

TECHNICAL FIELD

This invention relates to grain dryers and particularly to control systems for achieving a desired moisture content in grain passed through a dryer controlled thereby.

BACKGROUND ART

Various types of systems for drying grain and like materials are known. The systems described in the following listed U.S. patents are illustrative of the various known types of systems: U.S. Pat. Nos. 4,599,809; 4,896,795; 4,712,311; 4,253,244; 4,152,840; 4,149,844; 4,255,869; 4,558,523; 3,946,496; 4,555,858; 4,257,169; 4,916,830; 4,004,351; 4,490,924; 4,372,053; 4,386,471; 3,795,984; 4,253,243; 4,471,424; 4,696,115; 4,660,298; 4,513,759; 4,302,888; 3,787,985; 3,948,277; 4,434,563; 4,750,273; and, 4,578,878. This listing is not intended as a representation that a thorough search of all pertinent prior art has been conducted, or that no better prior art exists. Nor does this listing constitute an admission that any of the above-identified patents is pertinent prior art.

DISCLOSURE OF INVENTION

According to a first aspect of the invention, a control system is provided for a grain dryer having a path along which grain is conveyed from an entry opening between first and second walls provided with second openings through which drying air can flow, a source on the side of the first wall opposite the grain providing a flow of air through said first wall, through the grain between said walls, and through the second wall to reduce the moisture content of the grain, the grain dryer further comprising grain metering means between said walls adjacent the end thereof opposite the entry opening to control the movement of the grain along the path. The control system includes a first moisture probe means positioned adjacent the entry opening in the path, a second moisture probe means positioned adjacent the grain metering means, means for calculating the desired rate of movement of grain along the path, and means for coupling the first and second moisture probe means and the grain metering means to the means for calculating the desired rate of movement of grain along the path for control of the grain metering means based upon the outputs of the first and second moisture probe means.

Illustratively, the apparatus further comprises a first temperature probe means positioned adjacent the entry opening in the path, a second temperature probe means positioned adjacent the grain metering means, and means for coupling the first and second temperature probe means to the means for calculating the desired rate of movement of grain along the path for control of the grain metering means based in part upon the outputs of the first and second temperature probe means.

Additionally, illustratively, the apparatus further comprises dried grain discharge means adjacent the grain metering means for receiving dried grain moved along the path from the grain dryer, and means for mounting the second moisture probe means and the second temperature probe means in the flow of dried grain received by the dried grain discharge means.

Further, illustratively, the dried grain discharge means comprises conveyor means for conveying the received dried grain past the second moisture probe means and the second temperature probe means, and means in the flow of dried grain being discharged by the conveyor means to maintain the second moisture probe means and the second temperature probe means fully submerged in the flow of dried grain past the second moisture probe means and the second temperature probe means.

Additionally, illustratively, the apparatus further comprises third temperature probe means positioned on said side of said first wall opposite the grain, and means for coupling the third temperature probe means to the means for calculating the desired rate of movement of the grain along the path.

Additionally, illustratively, the apparatus further comprises fourth temperature probe means positioned on the side of the second wall opposite the grain, and means for coupling the fourth temperature probe means to the means for calculating the desired rate of movement of grain along the path.

Illustratively, the apparatus further comprises dried grain discharge means adjacent the grain metering means for receiving dried grain moved along the path from the grain dryer, and means for mounting the second moisture probe means in the flow of dried grain received by the dried grain discharge means. The dried grain discharge means comprises conveyor means for conveying the received dried grain past the second moisture probe means, and means in the flow of dried grain being discharged by the conveyor means to maintain the second moisture probe means fully submerged in the flow of dried grain past the second moisture probe means. The means for mounting the second moisture probe means in the flow of dried grain received by the dried grain discharge means comprises a housing having a bottom, means for mounting the second moisture probe means from the bottom of the housing to project upwardly into the flow of dried grain, and the means for maintaining the second moisture probe means fully submerged in the flow of dried grain comprises a flap hinged for pivotal movement about a generally horizontal hinge axis spaced above the bottom downstream in the flow of dried grain from the second moisture probe means and a counterweight mounted to resist pivotal movement of the flap on the hinge until an amount of dried grain is present on an upstream side of the flap to submerge the second moisture probe means fully in the flow of dried grain.

According to another aspect of the invention, a method for controlling the drying of grain in a grain dryer to approximately a desired moisture content comprises the steps of operating the grain dryer to fill it with grain that has been partially dried therein, measuring the moisture content of the grain adjacent an entry end of the grain dryer, measuring the moisture content of the grain adjacent an exit end of the grain dryer, establishing a drying rate for grain in the grain dryer, establishing from the drying rate an amount of time that the grain must be dried in order to achieve the desired moisture content, establishing from the amount of time a desired metering rate of grain through the dryer, and using the desired metering rate to control the flow of grain through the grain dryer.

Illustratively, the method further comprises the steps of periodically measuring the moisture content of the grain adjacent the entry end of the grain dryer, and updating the drying rate for grain in the grain dryer, the time that the grain must be dried in order to achieve the desired moisture content, and the desired metering rate of grain through the dryer, and using the updated desired metering rate to control the flow of grain through the grain dryer.

Additionally, illustratively, the method further comprises the steps of periodically measuring the moisture content of the grain adjacent the entry end of the grain dryer, periodically measuring the moisture content of grain adjacent the exit end of the grain dryer, and updating the drying rate of grain in the grain dryer, the time that the grain must be dried in order to achieve the desired moisture content, and the desired metering rate of grain through the grain dryer, and using the updated desired metering rate to control the flow of grain through the grain dryer.

Further, illustratively, the step of operating the grain dryer to fill it with grain that has been partially dried comprises the steps of filling the grain dryer with grain, measuring the moisture content of grain adjacent an entry end of the grain dryer, measuring the moisture content of grain adjacent an exit end of the grain dryer, and establishing a linear profile of moisture content of the grain in the grain dryer between the entry and exit ends thereof.

Additionally, illustratively, the step of establishing the drying rate comprises the steps of determining the drying rate from the moisture content of grain adjacent the entry end of the dryer, the moisture content of grain adjacent the exit end of the dryer, and a predicted moisture content of grain adjacent the exit end of the dryer. The predicted moisture content of grain adjacent the exit end of the dryer is determined based upon an initial, assumed rate of drying.

BRIEF DESCRIPTION OF DRAWINGS

The invention may best be understood by referring to the following detailed description and accompanying drawings which illustrate various aspects of the invention. In the drawings.

MODES FOR CARRYING OUT THE INVENTION

Figure 1:
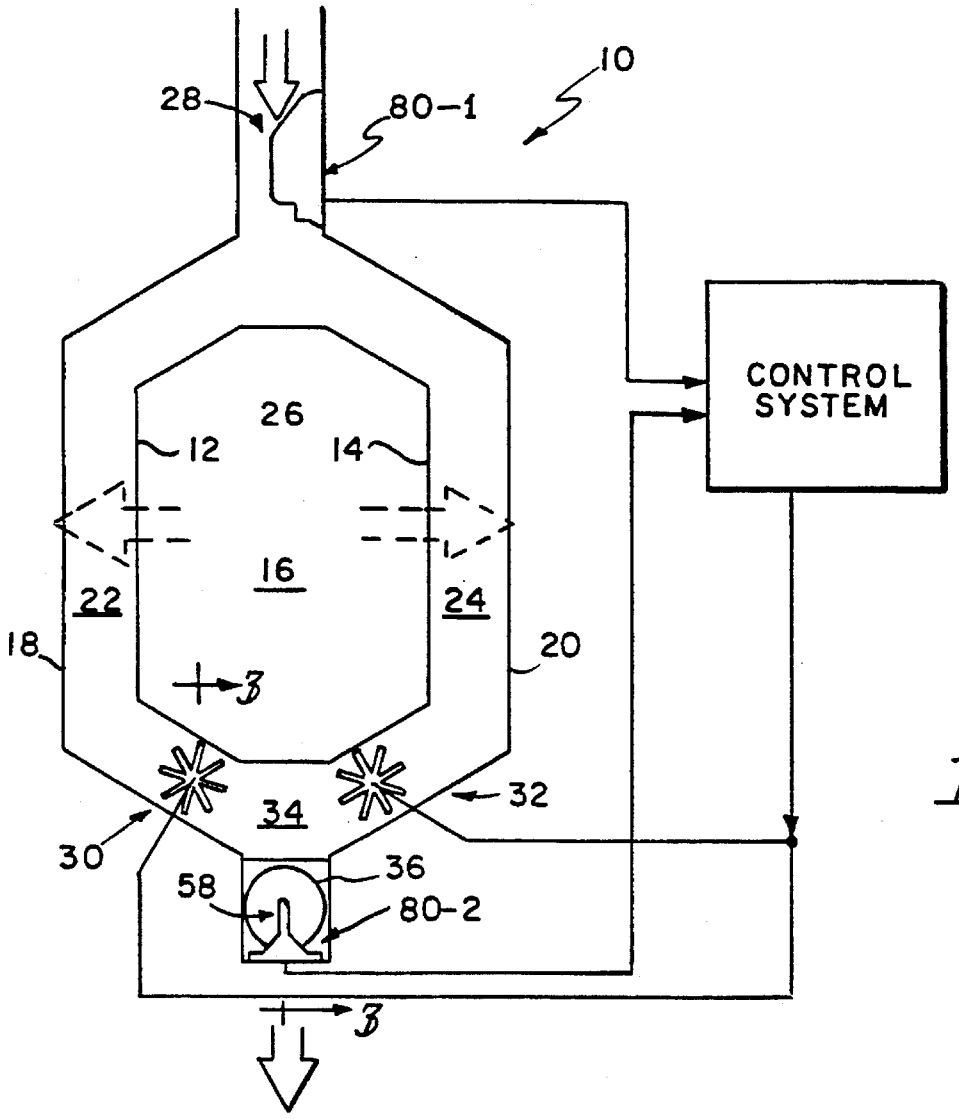
FIG. 1 illustrates a highly diagrammatic vertical sectional view taken transverse to the longitudinal extent of a grain dryer incorporating a control system according to the present invention.
Figure 3:
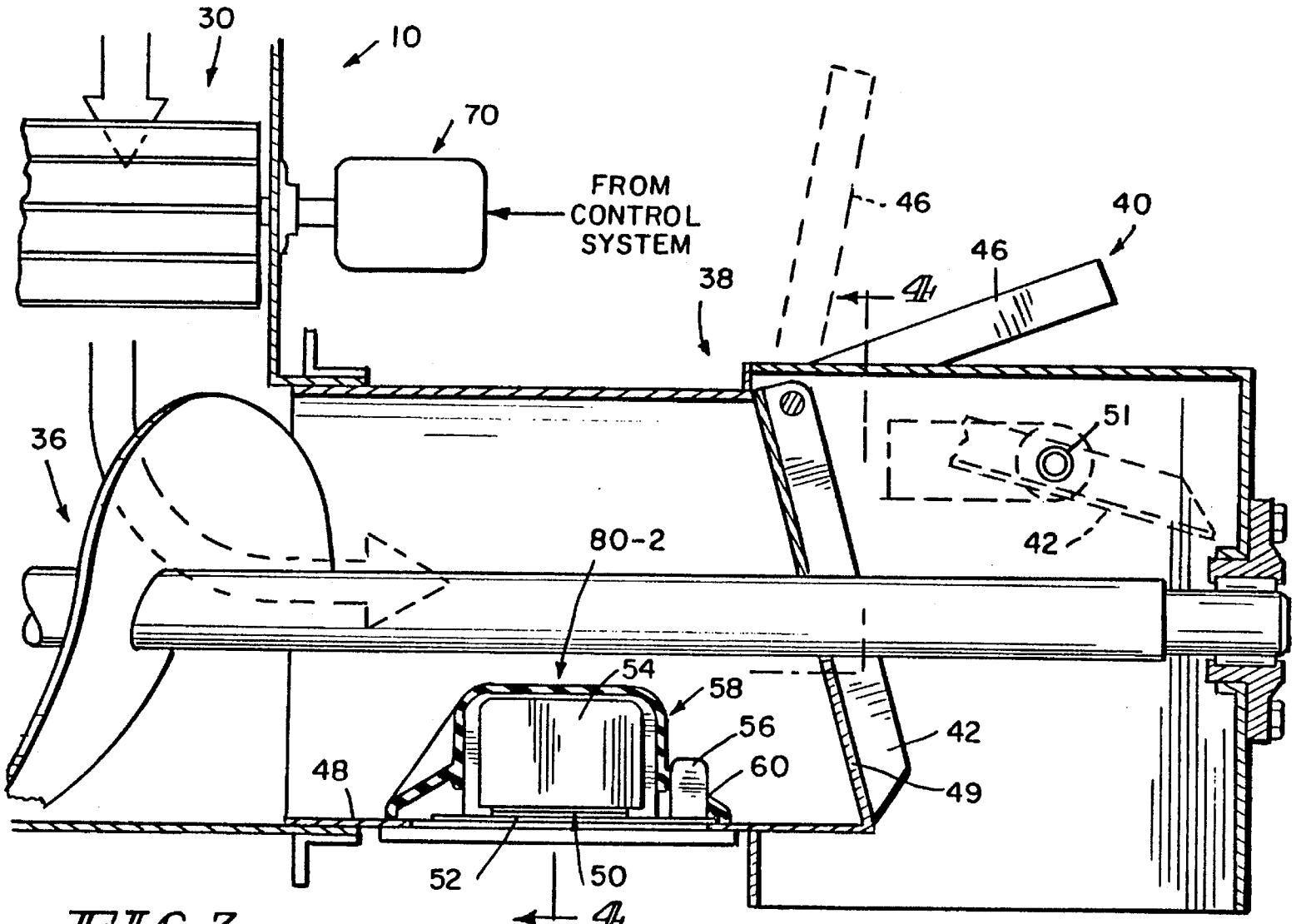
FIG. 3 illustrates an enlarged fragmentary sectional view of certain details of the systems illustrated in FIGS. 1–2, taken generally along section lines 3—3 thereof.
Figure 4:
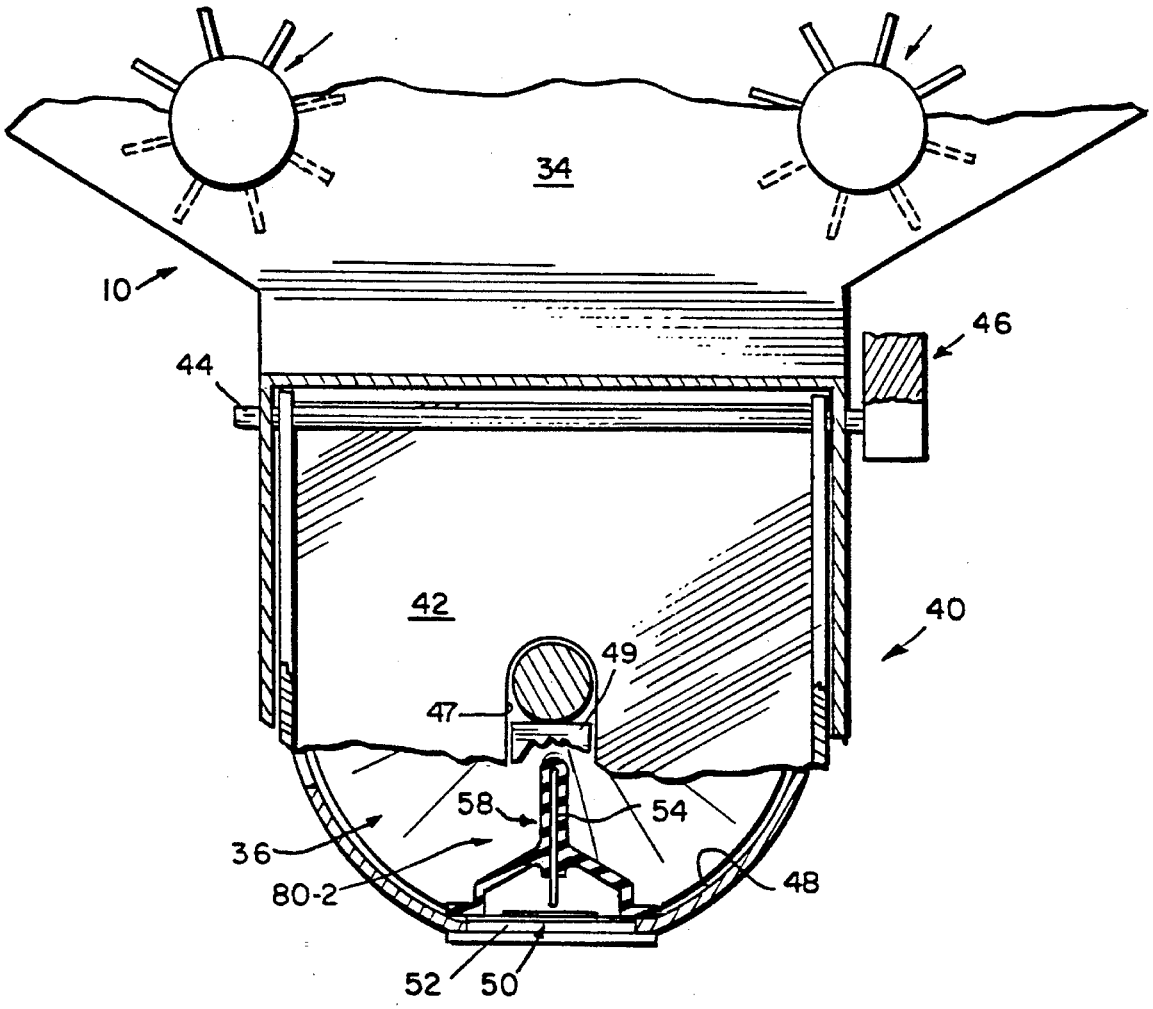
FIG. 4 illustrates an enlarged fragmentary sectional view of certain details of the systems illustrated in FIGS. 1–2, taken generally along section lines 4—4 of FIG. 3.

Turning now to FIGS. 1, 3 and 4, a conventional "heat only" grain dryer 10 includes a pair of interior walls 12, 14 defining between them a plenum chamber 16. Dryer 10 also includes a pair of exterior walls 18, 20 surrounding and enclosing the structure of walls 12, 14 and defining between walls 12, 18 and walls 14, 20, respectively, two grain drying paths 22, 24. Plenum chamber 16 is provided with air from suitable sources, such as fans (not shown) provided in its end walls, only one, 26, of which is shown. Walls 12, 14, 18, 20 are perforated to permit the flow of drying air therethrough to dry grain flowing downwardly along paths 22, 24. A means for heating air, such as an LP or fuel oil burner (not shown), is typically provided in plenum chamber 16.

Figure 2:
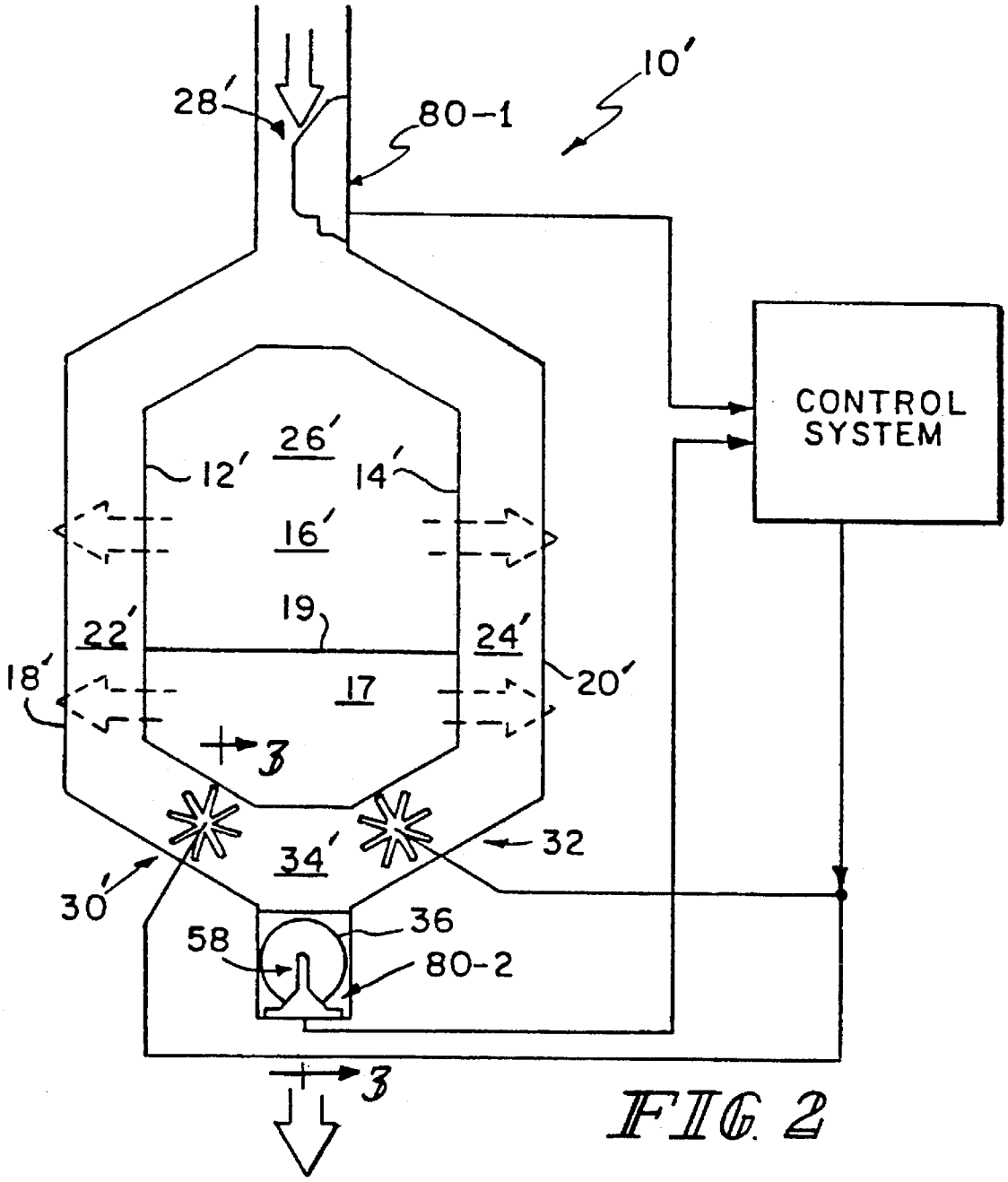
FIG. 2 illustrates a highly diagrammatic vertical sectional view taken transverse to the longitudinal extent of a grain dryer incorporating a control system according to the present invention.

Another common type of grain dryer, a so-called "dry and cool" dryer, is illustrated in FIG. 2. While heat only dryers, such as the dryer of FIG. 1 discharge hot grain, dried to the desired moisture content, dry and cool dryers discharge grain which has been heated, dried to within about ten percent of the total moisture desired to be removed, and then cooled back substantially to ambient temperature, removing the remaining moisture desired to be removed during this cooling process. Thus, with dry and cool dryers, substantial drying does not continue after the grain leaves the dryer owing to the radiation of heat stored in the grain.

Turning now to FIG. 2, a conventional dry and cool grain dryer 10' includes a pair of interior walls 12', 14' defining between them an upper, drying air plenum chamber 16' and a lower cooling air plenum chamber 17 separated by a wall 19. Dryer 10' also includes a pair of exterior walls 18', 20' surrounding and enclosing the structure of walls 12', 14' and defining between walls 12', 18' and walls 14', 20', respectively, two grain drying paths 22', 24'. Plenum chamber 16' is provided with heated drying air from suitable sources, such as fans (not shown) provided in its end walls, only one, 26', of which is shown. A means for heating air, such as an LP or fuel oil burner (not shown), is typically provided in plenum chamber 16'. Plenum chamber 17 is provided with cooling air from suitable sources, again, such as fans (not shown) provided in end walls 26'. Walls 12', 14', 18', 20' are perforated to permit the flow of drying and cooling air therethrough to dry grain flowing downwardly along paths 22', 24'.

Dry grain flows downwardly along paths 22, 24 (FIG. 1) or 22', 24' (FIG. 2) from a top entry slot 28 (FIG. 1) or 28' (FIG. 2) toward a pair of metering rolls 30, 32 (FIG. 1) or 30', 32' (FIG. 2) provided at the bottoms of paths 22, 24 (FIG. 1) or 22', 24' (FIG. 2), respectively, adjacent their junction 34 (FIG. 1) or 34' (FIG. 2). An auger-type conveyor 36 provided just below junction 34 or 34' conveys dried grain metered out of grain dryer 10 or 10' by metering rolls 30, 32 or 30', 32' toward an exit end housing 38 which is the same in either case. Exit end housing 38 has an outer end 40 covered by a flow-retarding flap 42. Flap 42 is pivotally mounted to the outer end 40 of housing 38 about a hinge 44, and is counterweighted 46 into a housing 38-closing orientation illustrated in solid lines in FIG. 3. Flap 42 is provided with a vertically extending slot 47 providing clearance for the auger 36 shaft. A metal strip 49 extends upward from the floor of housing 38 to minimize leakage of grain from housing 38 when flap 42 is closed.

A pair of moisture-and temperature-sensing probes 80-1 and 80-2 are provided in the path of grain flow through the grain dryer 10 or 10'. Probe 80-1 is provided at the top, or entry, end for grain to be dried into dryer 10 or 10', adjacent slot 28 or 28'. Probe 80-2 is provided on the floor 48 of housing 38. It will be appreciated that counterweighted 46 flap 42 insures that dried grain conveyed out of grain dryer 10 or 10' by auger 36 completely submerges probe 80-2 before any flow under flap 42 is permitted. The precise mounting location of probe 80-1 or 80-2 illustrated may or may not be achievable in a particular grain dryer, depending upon that dryer's configuration. Grain flows under flap 42 to a discharge conveyor (not shown) of known configuration. In the event that the discharge conveyor were to fail, dry grain would pile up on it, causing flap 42 to open further and further. A limit switch 51 is provided in housing 38 to detect such an occurrence and shut off the grain dryer.

Each probe 80-1 and 80-2 houses a printed circuit board 50 of essentially conventional configuration having circuit paths etched or otherwise provided thereon. The process of forming these paths leaves a fairly large, continuous metallization 52 on the back side of the circuit board 50. The metallization 52 is maintained at ground potential during the operation of the control system and consequently is sometimes referred to hereinafter as the ground plane of the circuit housed in each probe 80-1 and 80-2. Each probe 80-1 and 80-2 also includes a larger, illustratively steel, blade or paddle 54 and a smaller, illustratively copper, blade or paddle 56. Blades 54, 56 extend in the same direction away from the front (component) side of printed circuit board 50 and probes 80-1 and 80-2 are oriented in the flow of grain so as to provide the minimum restriction to the flow of grain past them. Illustratively, probes 80-1 and 80-2 are oriented so that blade 54 is upstream in the flow of grain from blade 56. A tough, durable, abrasion-resistant electrically insulative housing 58 filled with an electrically non-conductive material, such as General Electric 615 RTV silicone gel, encloses blade 54 and the printed circuit board 50 at its base. However, blade 56 extends through a narrow slot 60 in housing 58 so as to be in intimate, heat transferring relation with the grain flowing past probe 80-1 or 80-2. The silicone gel insulates blade 54 electrically from moisture in the grain.

Metering rolls 30, 32 or 30', 32' are driven to rotate by a variable speed DC motor 70. A transmission (not shown) at one end of grain dryer 10 or 10' couples the shafts of metering rolls 30, 32 or 30', 32' for synchronous rotation. The same transmission can also drive auger 36, since the dried grain to be conveyed out of grain dryer 10 or 10' by auger 36 is the sum of the amounts of grain metered through grain dryer 10 or 10' by metering rolls 30, 32 or 30', 32'.

Figure 5:
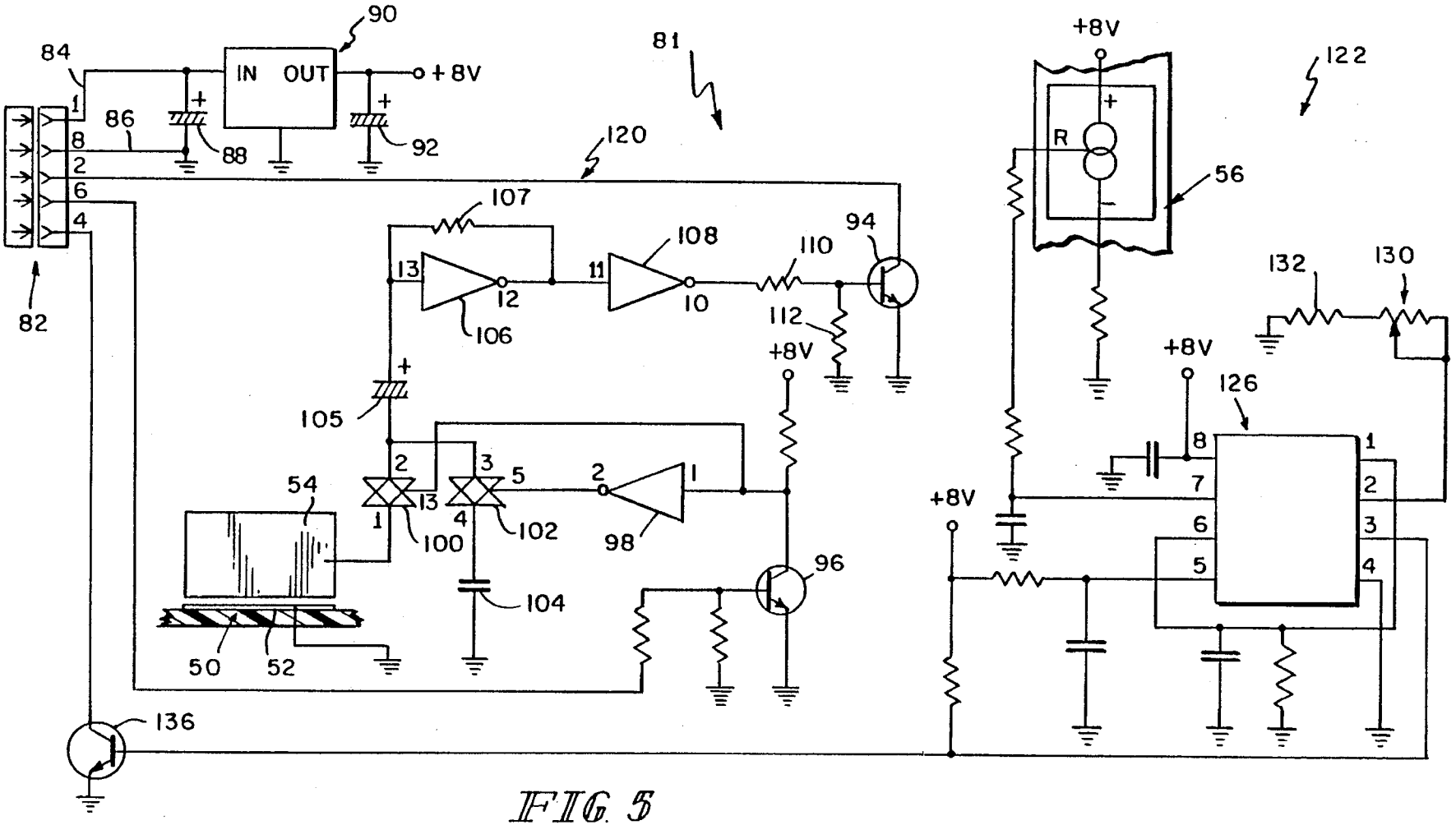
FIG. 5 illustrates a partly block and partly schematic diagram of an electric circuit incorporated into each of the grain moisture and temperature sensor probes of a control system constructed according to the present invention.
Figure 6:
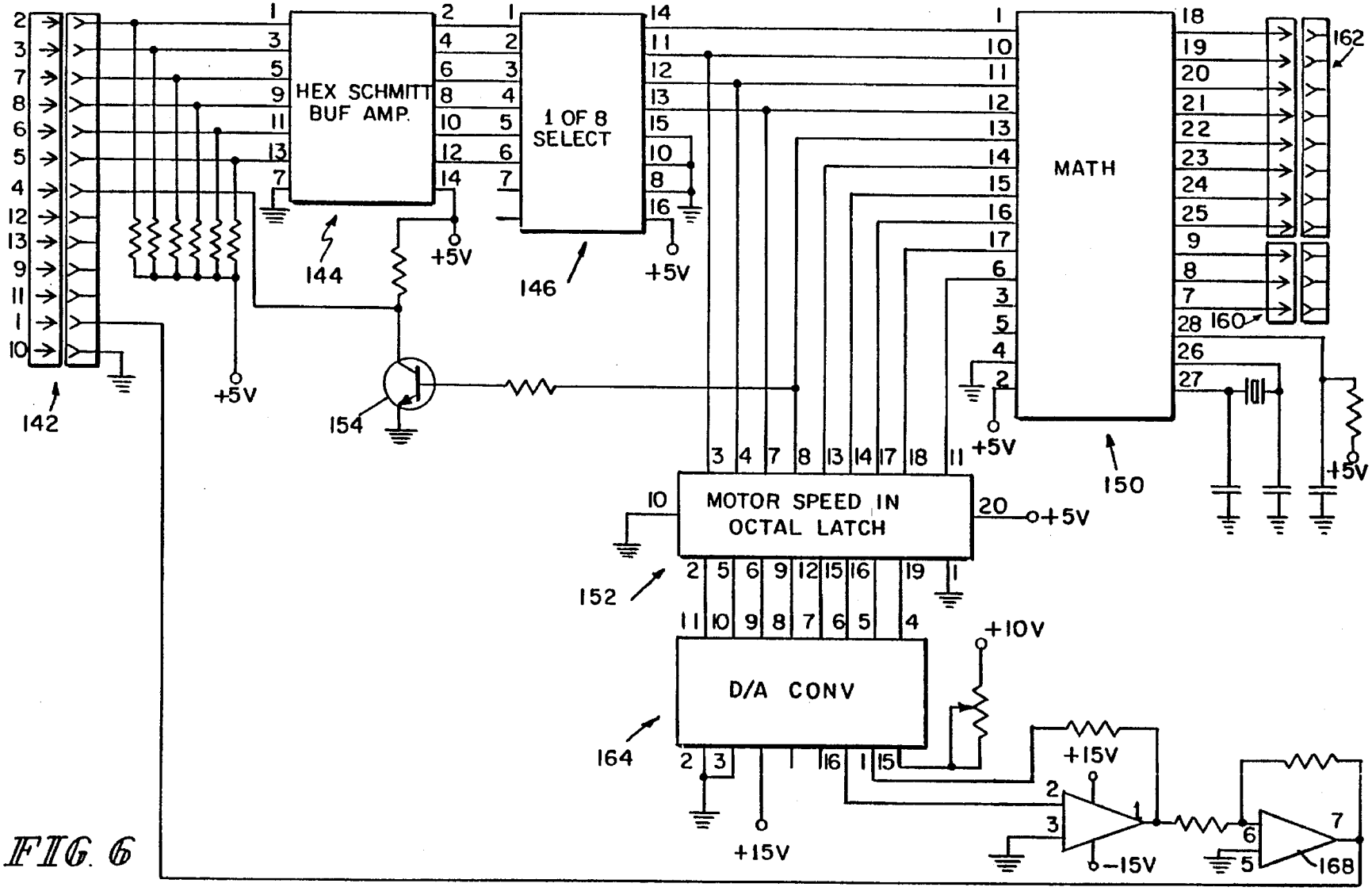
FIG. 6 illustrates a partly block and partly schematic diagram of an electric circuit incorporated into the controller of a control system constructed according to the present invention; and, FIGS. *7a–c* illustrate a flow chart of the program stored in, and executed by, the system of the present invention to control the drying of grain.
Figure 7A:
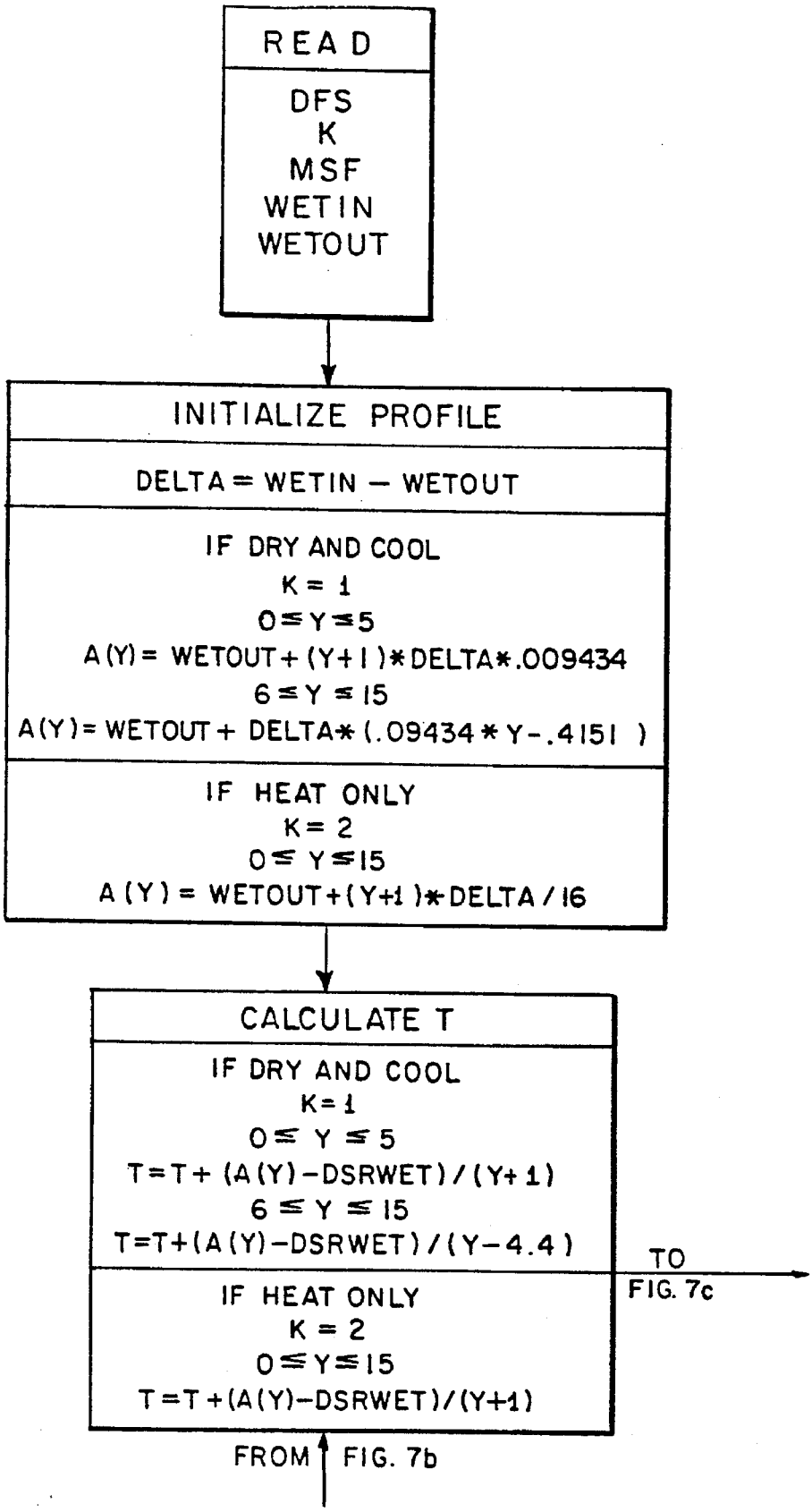
Figure 7B:
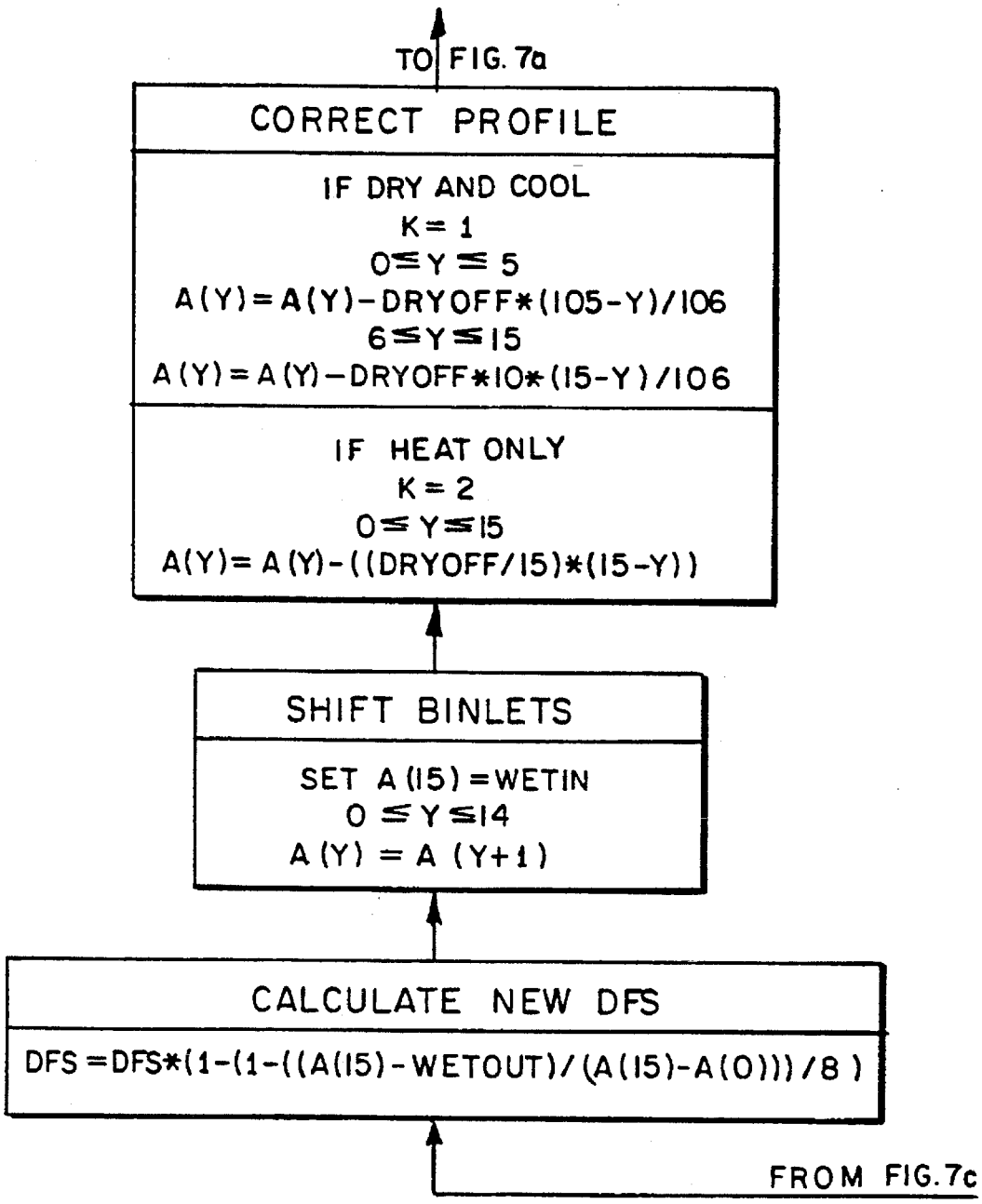
Figure 7C:
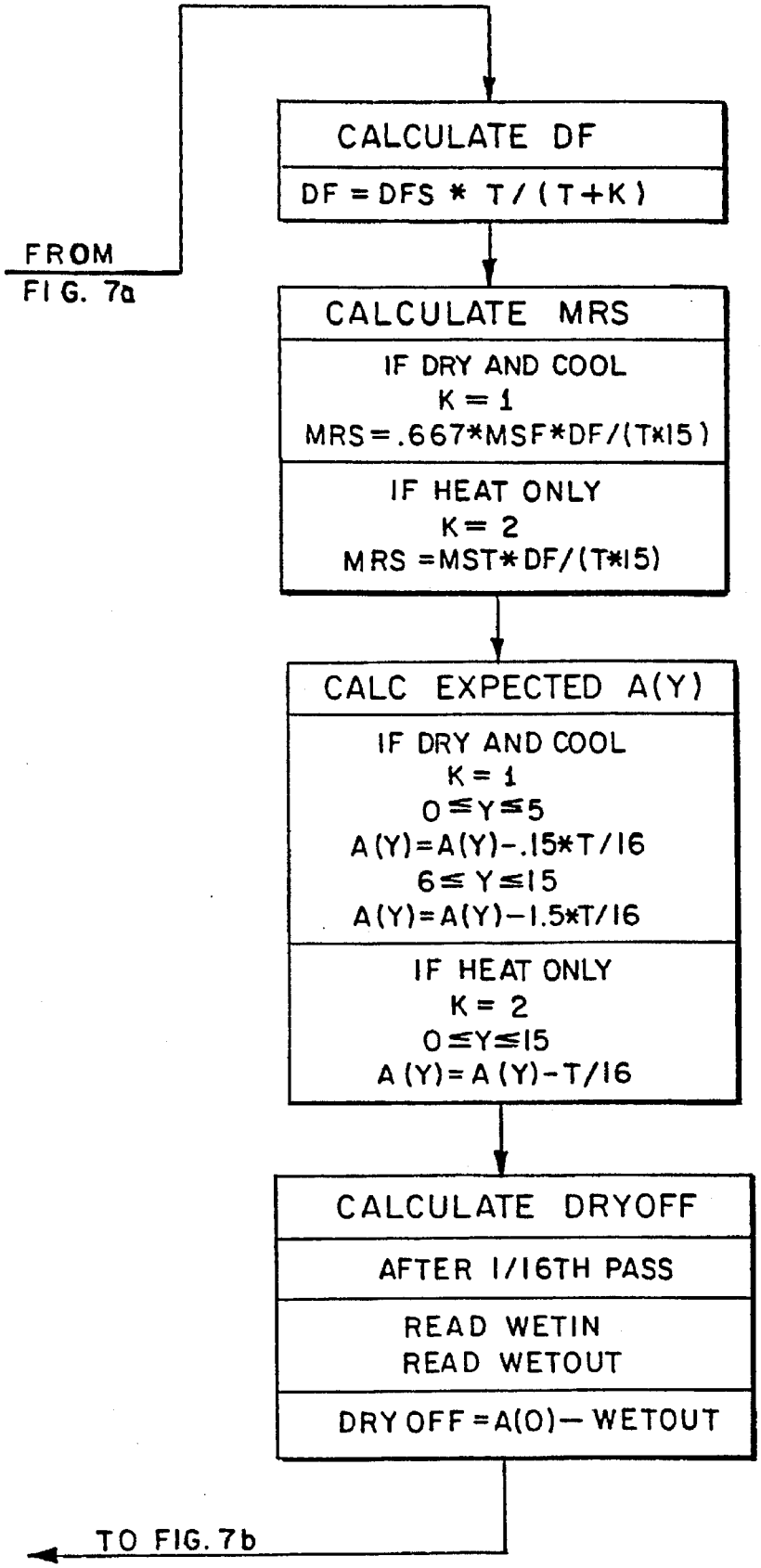

Turning now to FIG. 5, the electronics of one of probes 80-1 and 80-2 will be explained in some detail, it being understood that probes 80-1 and 80-2 are identical in configuration. Each probe 80-1, 80-2 includes an electric circuit 81 for generation and output of three signals, $F_W$, CAL and $F_T$, necessary for the accurate calculation of the moisture content of the grain flowing past the probe at any given time. Each of these signals is a train of rectangular pulses, the amplitude of which is the "rail-to-rail," or full supply, potential. This signalling approach permits these signals to be conveyed by their respective conductors over the substantial distances, sometimes in the hundreds of feet, convenient for monitoring grain drying operations.

Each circuit 81 includes a five-pin connector 82, across two pins 84, 86 of which is supplied unregulated voltage +V of greater than +8 VDC. This unregulated voltage +V is impressed across a 47 μF, 16 V capacitor 88 coupled across pins 84, 86, and across the IN and GND terminals of an integrated circuit +8 VDC regulated supply 90. IC 90 illustratively is a National Semiconductor type LM7808CT integrated circuit regulator. Regulated +8 VDC to power the circuit 81 is maintained across a 10 μF, 10 V capacitor 92 coupled across the OUT and GND terminals of IC 90. Wherever in this description specific terminals of an integrated circuit are identified, they are identified with respect to a particular IC. This convention is not intended to limit the generality of the description or claims, or as a representation that no other IC exists which can carry out the described functions, and no such limitation or representation should be inferred from this convention.

The $F_W$, or wetness frequency, signal-carrying pin of connector 82 is coupled to the collector of an NPN transistor 94, such as a type 2N3904 transistor. The emitter of transistor 94 is coupled to ground. This configuration provides the previously mentioned +5 VDC rail-to-rail potential swing in the $F_W$ signal. The CAL, or calibrate, pin of connector 82 is coupled through a 10K resistor to the base of an NPN transistor 96, such as a type 2N3904 transistor. The base of transistor 96 is coupled to ground through a 2.7K resistor. The emitter of transistor 96 is coupled to ground, and its collector is coupled through a 100K pull-up resistor to +8 VDC. The collector of transistor 96 is also coupled directly to an input terminal of an inverting amplifier 98 and to a control terminal of an analog switch 100. An output terminal of inverting amplifier 98 is coupled control terminal of an analog switch 102.

One controlled terminal of analog switch 100 is coupled to blade 54 of its respective probe 80. The ground plane 52 of the respective probe 80's printed circuit board 50, on which many of the components of circuit 81 are mounted, is coupled to ground. One controlled terminal of analog switch 102 is coupled through a 100 pF, NPO, calibrate capacitor 104 to ground. The remaining controlled terminals of analog switches 100, 102 are coupled to each other and through a 47 μF capacitor 105 to an input terminal of an inverting amplifier 106. Analog switches 100, 102 illustratively are a Motorola MC14066 dual analog switch IC. An output terminal of inverting amplifier 106 is coupled through a 39K, 1% feedback resistor 107 to its input. The output terminal of inverting amplifier 106 is also coupled to an input terminal of an inverting amplifier 108. An output terminal of inverting amplifier 108 is coupled through series 10K and 2.7K resistors 110, 112, respectively, to ground, and the Junction of resistors 110, 112 is coupled to the base of transistor 94. Inverting amplifiers 98, 106, 108 illustratively are three inverting amplifiers of a National Semiconductor LM74C14 quad inverting amplifier IC.

The circuit including the blade 54-to-ground plane 52 capacitance of the probe 80-1 or 80-2, the calibrate capacitor 104, capacitor 105, inverting amplifier 106 and resistor 107 constitutes an oscillator 120. The output frequency of oscillator 120 in part is determined, in the calibrate mode by series capacitors 104 and 105, and in the wetness measuring mode by the probe's blade 54-to-ground plane 52 capacitance in series with capacitor 105. This capacitance is affected by the dielectric strength and, thus, the wetness, of the grain flowing through the blade 54-to-ground plane 52 space. The oscillator 120 is placed in the calibrate mode by a logic "1" level on the base of transistor 96. This opens analog switch 100 and closes analog switch 102. A calibrate frequency in the 118 KHz range results at the collector of transistor 94. The oscillator 120 is placed in the wetness measurement mode by a logic "0" level on the base of transistor 96. This closes analog switch 100 and opens analog switch 102. The output frequency of the oscillator 120 is then determined in part by the moisture content of the grain flowing between the blade 54 and ground plane 52 of the probe, and this output frequency appears at the collector of transistor 94.

The temperature of the grain is the remaining significant parameter in an accurate calculation of grain moisture content. Each probe 80-1 and 80-2 includes a circuit 122 for determining the temperature of the grain flowing past it. Circuit 122 includes a current source 124, such as a National Semiconductor type LM234H-3 integrated circuit, and a temperature-to-frequency (T/F) converter 126, such as an Exar type XR4151P integrated circuit. The +V terminal of current source 124 is coupled to +8 VDC. The −V terminal of current source 124 is coupled through a 10K, 1% resistor to ground and through a 100K, 1% resistor to pin 7 of T/F converter 126. A 226Ω, 1% resistor is coupled across the R and −V terminals of current source 124. A 0.01 μF, NPO capacitor is coupled across pin 7 of T/F converter 126 and ground. +8 VDC is coupled to pin 8 of T/F converter 126 and through a 68K, 1% resistor to pin 5 of T/F converter 126. A 0.1 μF capacitor is coupled between pin 8 of T/F converter 126 and ground. A 0.01 μF, NPO capacitor is coupled between pin 5 of T/F converter 126 and ground. Pins 1 and 6 of T/F converter 126 are coupled together and to ground through a parallel RC circuit including a 100K, 1% resistor and a 1 μF tantalum capacitor. Pin 4 of T/F converter 126 is coupled to ground. A series resistive circuit including a 5K, ten-turn, 100 parts-per-million, 1%, temperature compensation potentiometer 130 and a 12K, 1% resistor 132 is coupled between pin 2 of T/F converter 126 and ground.

The temperature input to circuit 122 is provided through current source 124 which is mounted in heat transfer relation with copper blade 56 which projects from each probe 80-1 and 80-2 into the stream of grain flowing past the probe 80. This mounting illustratively comprises a piece of electrically non-conductive plumber's Teflon® PTFE tape adhered by an electrically non-conductive silicone grease between the blade 56 and current source 124 to permit heat flow between these two while preventing current flow between them. The output from circuit 122 is provided at the collector of an NPN transistor 136, the emitter of which is coupled to ground and the base of which is coupled through a 10K pull-up resistor to +8 VDC and directly to pin 3 of T/F converter 126. The collector of transistor 136 is coupled to the $F_T$, or temperature frequency, pin of connector 82.

A connector 142 couples the $F_W$ and $F_T$ terminals of both the upper and lower probes 80-1 and 80-2 through respective 100Ω pull-up resistors to a +5 VDC supply. Terminals $F_{W1}$, $F_{T1}$, $F_{W2}$ and $F_{T2}$ are also coupled to respective input terminals, pins 1, 3, 5, and 9, of a hex Schmitt buffer amplifier integrated circuit 144, such as an RCA type 40106 IC. An ambient temperature frequency input, $F_{AMB}$, is generated by a temperature-to-frequency conversion circuit (not shown) similar to circuit 122, but mounted to sense the ambient temperature outside grain dryer 10. This input is coupled through a 100Ω pull-up resistor to +5 VDC supply and directly to an input terminal, pin 11, of IC 144. A grain dryer plenum chamber 16 temperature frequency input, $F_{PLM}$ is generated by a temperature-to-frequency conversion circuit (not shown) similar to circuit 122, but mounted to sense a temperature in the plenum chamber of the grain dryer. This input is coupled through a 100Ω pull-up resistor to +5 VDC supply and directly to an input terminal, pin 13, of IC 144. Pin 7 of IC 144 is coupled to ground. On the output side of IC 144, pins 2, 4, 6, 8, 10 and 12 thereof are coupled to pins 1–6, respectively of a one-of-eight select integrated circuit 146, such as an RCA type 4512 IC. Pins 11–14 of IC 146 are coupled to the RB0, RB1, RB2 and RTCC input terminals, pins 10, 11, 12 and 1, respectively, of a microcomputer integrated circuit 150, such as a Microchip type PIC16C57 IC. Pins 10–12 of microcomputer IC 150 are also coupled to pins 3, 4 and 7, respectively, of an octal latch integrated circuit 152, such as a type 74HC373 IC.

The RB3–RB7 terminals, pins 13–17, respectively, of microcomputer IC 150 are coupled to pins 8, 13, 14, 17 and 18, respectively, of octal latch IC 152. Pin 8 of IC 152 is also coupled through a 10K resistor to the base of an NPN transistor 154, such as a type 2N3904. The emitter of transistor 154 is coupled to ground and its collector is coupled through a 10K pull-up resistor to +5 VDC supply. The collector of transistor 154 is also coupled to the CAL terminal of connector 142, to which the CAL terminals of both probes 80-1 and 80-2 are coupled. The state of transistor 154 controls whether frequency calibrate information or wetness frequency information from probes 80-1 and 80-2 is being supplied at the $F_{W1}$ and $F_{W2}$ terminals, respectively, of connector 142.

The RA0 terminal, pin 6, of microcomputer IC 150 is coupled to pin 11 of octal latch IC 152. The VCC and GND terminals, pins 2 and 4, respectively, of microcomputer IC 150 are coupled to +5 VDC supply and ground. A three pin communications bus connector 160 is coupled to the RA1–RA3 terminals, pins 7–9, respectively, of microcomputer IC 150. An eight pin parallel data bus connector 162 is coupled to the parallel data terminals RC0–RC7, pins 18–25, respectively, of microcomputer IC 150. A 4 MHz clock crystal, the terminals of which are coupled to ground through 30 pF capacitors, is coupled across the OSC1 and OSC2 terminals, pins 27 and 26, respectively, of microcomputer IC 150. +5 VDC supply is coupled through an RC circuit including a 10K resistor and a 0.01 μF capacitor to the MCLR terminal, pin 28, of microcomputer IC 150.

The Q0–Q7 terminals, pins 2, 5, 6, 9, 12, 15, 16 and 19, respectively, of octal latch IC 152 are coupled to input pins 11–4, respectively, of an integrated circuit D/A converter 164, such as an Analog Devices type AD7523 IC. Pins 1 and 10 of octal latch IC 152 are coupled to ground and its VCC terminal, pin 20, is coupled to +5 VDC supply. The analog output voltage range of D/A 164 is established by a potentiometer coupled between a +10 VDC supply and pin 15 thereof. The analog output voltage of D/A 164 appears across pins 1 and 16 thereof. Pin 16 thereof is coupled to the inverting (−) input terminal, pin 2, of a difference amplifier 166. The non-inverting (+) input terminal of difference amplifier 166 is coupled to ground. The output terminal of difference amplifier 166 is coupled through a 68K resistor to the − input terminal of a difference amplifier 168 and through a 1K feedback resistor to pin 1 of D/A 164. The + input terminal of difference amplifier 168 is coupled to ground. Its output terminal is coupled through a 68K feedback resistor to its − input terminal. Its output terminal produces the analog commanded metering roll drive motor 70 speed signal which appears on the MOTOR SPEED terminal of connector 142. Difference amplifiers 166 and 168 illustratively are a National Semiconductor LM358 dual difference amplifier integrated circuit.

In connection with the following description of certain calculations made by the software stored in microcomputer 150, the following variables are defined: y=an arbitrary number of vertically oriented segments into which the grain dryer 10 or 10' is divided for purposes of calculating desired metering roll 30, 32 or 30', 32' drive motor 70 speed (in the present example, $0 \leqq y \leqq 15$) in the software which will be described herein, y ranges from zero at the bottom, or exit, end of the dryer 10 or 10', to fifteen at the top, or entry, end of the dryer 10 or 10' for a total of sixteen vertically arrayed segments;

A(y)=the calculated current wetness of the yth dryer segment;

DSRWET=the desired wetness of the grain dryer 10 or 10' output, the moisture setting selected by the operator;

DELTA=WETIN—WETOUT

WETIN=wetness at incoming sensor

WETOUT=wetness at outgoing sensor

A(y)=wetness in the (y) segment y=0 TO 15

DF=drying factor in points (%) of moisture removed per unit time

MSF=time to unload a dryer at 100% meter roll speed

MRS=meter roll speed in percentage of maximum meter roll speed. This corresponds to the signal sent to D/A 164

DRYOFF=drying offset from predicted A(O) moisture to actual moisture content of the outgoing grain DFS=drying factor saved in memory T—total wetness removed. This is the summation of wetnesses to be removed in each of the y segments divided by position The flowchart of FIGS. *7a–c* illustrates a technique for controlling the motor speed control signal to effect control of the metering rolls 30, 32 in a HEAT only dryer 10, or the metering rolls 30', 32' in a DRY AND COOL grain dryer 10'.

Features of the program illustrated in the flowchart of FIGS. *7a–c* include provision of control for both heat only and dry and cool grain dryers 10, 10', respectively, and a low moisture removal feature. Sometimes grain is being dryed in a grain dryer 10, 10' of either type which already has a low moisture content (e.g. within a few point (%) of its desired moisture content DSRWET). When such grain is being dryed, the program includes a step which increases its sensitivity to reduce to the extent possible overdrying of the grain and its attendant problems. That step is the CALCULATE DF step in which the drying factor DF is adjusted for T, the total wetness to be removed from the grain being dryed.

We claim:

1. A method for controlling the drying of grain in a grain dryer to approximately a desired moisture content comprising the steps of operating the grain dryer to fill it with grain that has been partially dried therein, measuring the moisture content of the grain adjacent an entry end of the grain dryer, measuring the moisture content of the grain adjacent an exit end of the grain dryer, establishing a drying rate for grain in the grain dryer, establishing from the drying rate an amount of time that the grain must be dried in order to achieve the desired moisture content, establishing from the amount of time a desired metering rate of grain through the dryer, and using the desired metering rate to control the flow of grain through the grain dryer, the step of establishing a drying rate for grain in the grain dryer comprising the steps of establishing a first drying rate for grain between the entry end of the grain dryer and a location along the path of the grain through the grain dryer and establishing a second, reduced drying rate for grain between the location and the exit end of the grain dryer, the first drying rate being in the range of about ten times the second drying rate.

2. The method of claim 1 further comprising the steps of periodically measuring the moisture content of the grain adjacent the entry end of the grain dryer, and updating the drying rate for grain in the grain dryer, the time that the grain must be dried in order to achieve the desired moisture content, and the desired metering rate of grain through the dryer, and using the updated desired metering rate to control the flow of grain through the grain dryer.

3. The method of claim 1 further comprising the steps of periodically measuring the moisture content of the grain adjacent the entry end of the grain dryer, periodically measuring the moisture content of grain adjacent the exit end of the grain dryer, and updating the drying rate of grain in the grain dryer, the time that the grain must be dried in order to achieve the desired moisture content, and the desired metering rate of grain through the grain dryer, and using the updated desired metering rate to control the flow of grain through the grain dryer.

4. The method of claim 1 wherein the step of operating the grain dryer to fill it with grain that has been partially dried comprises the steps of filling the grain dryer with grain, measuring the moisture content of grain adjacent an entry end of the grain dryer, measuring the moisture content of grain adjacent an exit end of the grain dryer, and establishing a linear profile of moisture content of the grain in the grain dryer between the entry and exit ends thereof.

5. The method of claim 1 wherein the step of establishing the drying rate comprises the steps of determining the drying rate from the moisture content of grain adjacent the entry end of the dryer, the moisture content of grain adjacent the exit end of the dryer, and a predicted moisture content of grain adjacent the exit end of the dryer.

6. The method of claim 5 wherein the predicted moisture content of grain adjacent the exit end of the dryer is determined based upon an initial, assumed rate of drying.

7. The method of claim 1 further comprising the steps of periodically measuring the moisture content of the grain adjacent the exit end of the grain dryer, and updating the drying rate for grain in the grain dryer, the time that the grain must be dried in order to achieve the desired moisture content, and the desired metering rate of grain through the dryer, and using the updated desired metering rate to control the flow of grain through the grain dryer.

8. The method of claim 1 wherein the drying rate is adjusted for the total amount of moisture to be removed from the grain in the grain dryer, with the drying rate being reduced when a relatively smaller total amount of moisture is to be removed from the grain, and the drying rate being increased when a relatively larger total amount of moisture is to be removed from the grain.

* * * * *